US010941550B2

(12) United States Patent
Pancurák et al.

(10) Patent No.: US 10,941,550 B2
(45) Date of Patent: Mar. 9, 2021

(54) TOILET BOWL PRESSURE FLUSHING SYSTEM WITH SHOCK WAVE FLUSHING

(71) Applicant: Swiss Aqua Technologies AG, Diepoldsau (CH)

(72) Inventors: František Pancurák, Prešov (SK); Zuzana Pancuráková, Prešov (SK)

(73) Assignee: SWISS AQUA TECHNOLOGIES AG, Diepoldsau (CH)

( * ) Notice: Subject to any disclaimer, the term of this patent is extended or adjusted under 35 U.S.C. 154(b) by 541 days.

(21) Appl. No.: 15/565,033

(22) PCT Filed: Apr. 7, 2016

(86) PCT No.: PCT/SK2016/050004
§ 371 (c)(1),
(2) Date: Sep. 6, 2018

(87) PCT Pub. No.: WO2016/163959
PCT Pub. Date: Oct. 13, 2016

(65) Prior Publication Data

US 2018/0363281 A1 Dec. 20, 2018

(30) Foreign Application Priority Data

| | | |
|---|---|---|
| Apr. 7, 2015 | (SK) | 5014-2015 |
| Mar. 17, 2016 | (SK) | 5008-2016 |
| Mar. 17, 2016 | (SK) | 5009-2016 |

(51) Int. Cl.
*E03D 3/10* (2006.01)
*E03D 5/02* (2006.01)

(52) U.S. Cl.
CPC ..... *E03D 3/10* (2013.01); *E03D 5/024* (2013.01)

(58) Field of Classification Search
CPC ..... E03D 5/024; E03D 3/10
(Continued)

(56) References Cited

U.S. PATENT DOCUMENTS 261,583 A * 7/1882 Coggin ..... E03D 3/10 4/362
672,431 A * 4/1901 La Bonte ..... E03D 3/10 4/361

(Continued)

FOREIGN PATENT DOCUMENTS

BE 496 594 A 10/1950
CN 101761124 A 12/2011

(Continued)

OTHER PUBLICATIONS

International Search Report and Written Opinion—PCT/SK2016/050004—ISA/EPO—dated Oct. 14, 2016.

*Primary Examiner* — Patrick M. Buechner
(74) *Attorney, Agent, or Firm* — Muncy, Geissler, Olds & Lowe, P.C.

(57) ABSTRACT

A toilet bowl pressure flushing system with shock wave flushing is a compact rigid unit made by a fixed connection of: a rigid body of a pressure module containing at least one gas hydraulic accumulator and one downstream flow tank connected by at least one connection opening; an overflow pipe; an automatic hydraulic valve module comprising a core, an inlet and outlet elements of the automatic hydraulic valve, where the inlet element of the automatic hydraulic valve is connected to the outlet of the flow tank and where the outlet element of the automatic hydraulic valve feeds into the overflow pipe. At the same time it comprises an inlet from the pressure water supply that feeds into the rigid body of the pressure module or into the automatic hydraulic valve module.

5 Claims, 9 Drawing Sheets

(58) Field of Classification Search
USPC ..... 4/360–362
See application file for complete search history.

(56) References Cited

U.S. PATENT DOCUMENTS

| | | | | | |
|---|---|---|---|---|---|
| 746,324 | A | | 12/1903 | Gillin | |
| 787,833 | A | * | 4/1905 | Crary | E03D 3/10 4/360 |
| 1,348,384 | A | * | 8/1920 | Verre | E03B 7/075 138/27 |
| 1,586,079 | A | * | 5/1926 | Formaneck | E03D 3/10 4/357 |
| 1,639,288 | A | * | 8/1927 | Giardino | E03D 3/12 4/362 |
| 1,658,169 | A | * | 2/1928 | Krauss | E03D 3/04 4/360 |
| 2,658,203 | A | | 11/1953 | Aue | |
| 2,659,089 | A | * | 11/1953 | Griffon | E03D 3/10 4/357 |
| 2,915,761 | A | * | 12/1959 | Langdon | E03D 1/33 4/360 |
| 3,029,443 | A | * | 4/1962 | Naccarato | E03D 3/10 4/362 |
| 3,466,673 | A | * | 9/1969 | Boccard | E03D 3/10 4/376 |
| 3,566,416 | A | * | 3/1971 | Altieri | E03D 3/10 4/363 |
| 3,605,125 | A | * | 9/1971 | Gibbs | E03D 3/10 4/361 |
| 3,662,408 | A | * | 5/1972 | Knudtson | E03D 1/34 4/407 |
| 3,790,967 | A | * | 2/1974 | Pignato | E03D 3/10 4/358 |
| 3,817,286 | A | * | 6/1974 | Caron | E03D 3/06 137/628 |
| 3,820,171 | A | * | 6/1974 | Larson | E03D 3/04 4/360 |
| 3,820,754 | A | * | 6/1974 | Caron | E03D 3/10 251/38 |
| 3,905,050 | A | * | 9/1975 | Goza | E03D 3/10 4/358 |
| 4,115,883 | A | * | 9/1978 | Dauvergne | E03D 3/10 4/353 |
| 4,142,262 | A | * | 3/1979 | Hamilton | E03D 3/10 4/354 |
| 4,183,108 | A | * | 1/1980 | Hamilton | E03D 1/22 4/354 |
| 4,232,409 | A | * | 11/1980 | Van Pham | E03D 3/00 4/362 |
| 4,275,471 | A | * | 6/1981 | Becker | E03D 1/30 4/324 |
| 4,375,109 | A | * | 3/1983 | Jones | B01F 1/0027 222/424.5 |
| 4,756,031 | A | * | 7/1988 | Barrett | E03D 5/105 4/313 |
| 4,858,251 | A | * | 8/1989 | de Belaunde | E03D 3/10 4/358 |
| 4,955,921 | A | * | 9/1990 | Basile | E03D 3/10 4/354 |
| 4,984,311 | A | * | 1/1991 | Basile | E03D 3/10 4/354 |
| 4,999,859 | A | * | 3/1991 | Bolze | E03D 5/00 4/300 |
| 5,027,444 | A | * | 7/1991 | Tsals | E03D 5/024 4/226.1 |
| 5,241,711 | A | * | 9/1993 | Badders | E03D 3/10 251/33 |
| 5,361,426 | A | * | 11/1994 | Martin | E03D 3/04 251/41 |
| 5,363,513 | A | * | 11/1994 | Blankenburg | E03D 3/10 4/354 |
| 5,487,193 | A | * | 1/1996 | Hennessy | E03D 3/10 222/341 |
| 5,553,333 | A | | 9/1996 | Andersson | |
| 5,661,855 | A | * | 9/1997 | Osmond | E03D 1/00 137/135 |
| 5,970,527 | A | * | 10/1999 | Martin | E03D 3/10 4/361 |
| 6,029,287 | A | * | 2/2000 | Ge | E03D 3/10 4/334 |
| 6,263,519 | B1 | * | 7/2001 | Parsons | E03D 1/34 4/300 |
| 6,360,378 | B2 | * | 3/2002 | Martin | E03D 3/10 4/354 |
| 6,457,187 | B1 | * | 10/2002 | Andersson | E03D 3/10 4/354 |
| 6,470,505 | B1 | | 10/2002 | Boisvert | |
| 6,502,252 | B1 | * | 1/2003 | Kang | E03D 1/22 4/300 |
| 2006/0085901 | A1 | * | 4/2006 | Janssen | E03D 3/10 4/354 |
| 2006/0107451 | A1 | * | 5/2006 | Kuster | E03D 3/10 4/354 |
| 2006/0123532 | A1 | * | 6/2006 | Reichmuth | E03D 3/10 4/354 |
| 2006/0130225 | A1 | * | 6/2006 | Muderlak | E03D 3/10 4/405 |
| 2006/0282942 | A1 | * | 12/2006 | Martin | E03D 3/10 4/353 |
| 2007/0204392 | A1 | * | 9/2007 | Lo | E03D 3/10 4/354 |
| 2009/0144889 | A1 | * | 6/2009 | Hennessay | E03D 3/10 4/420 |
| 2009/0151062 | A1 | * | 6/2009 | Martin | E03D 3/10 4/354 |
| 2009/0151063 | A1 | * | 6/2009 | Shirai | E03D 3/10 4/415 |
| 2010/0186157 | A1 | * | 7/2010 | Roeser | E03D 1/306 4/354 |
| 2010/0212078 | A1 | * | 8/2010 | Dong | E03D 3/10 4/354 |
| 2010/0299822 | A1 | | 12/2010 | Vargas et al. | |
| 2012/0210506 | A1 | * | 8/2012 | Miwa | E03D 11/02 4/431 |
| 2014/0208497 | A1 | | 7/2014 | Li | |
| 2014/0289948 | A1 | | 10/2014 | Kitaura et al. | |
| 2019/0032316 | A1 | * | 1/2019 | Boyes | E03D 5/024 |

FOREIGN PATENT DOCUMENTS

| | | | |
|---|---|---|---|
| CN | 104074247 | A | 1/2016 |
| EP | 0063701 | A1 | 11/1982 |
| FR | 2552135 | A1 | 3/1985 |
| FR | 2583220 | Y | 10/2003 |

* cited by examiner

TOILET BOWL PRESSURE FLUSHING SYSTEM WITH SHOCK WAVE FLUSHING

This application is a 371 National Phase of PCT Application No. PCT/SK2016/050004, filed on Apr. 7, 2016; and this application claims priority of Application No. PP 5014-2015 filed in Slovakia on Apr. 7, 2015, Application No. PP 5008-2016 filed in Slovakia on Mar. 17, 2016 and Application No. PP 5009-2016 filed in Slovakia on Mar. 17, 2016, each of which is herein incorporated by reference in its entirety.

FIELD OF INVENTION

The present invention relates to a structural design of a toilet bowl pressure flushing system with shock wave flushing providing for perfect flushing with low water consumption and preventing possible drinking water contamination by backflow. For purposes of this invention the term toilet bow "pressure flushing system" shall mean a sanitary appliance designed for toilet bowl flushing. The invention falls within the field of sanitary equipment and appliances.

PRIOR ART

Well known in the) sanitation prior art are pressure flushing devices in which a self-closing push button valve of a complex design and a small flow rate is connected directly to the pressurized water supply. That is why these pressure flushing devices, having typically a ¼" pressure water inlet, are suitable only for flushing urinals. These flushing devices are not suitable for toilet bowl flushing, because without having any means for pressure water storage they do not provide sufficient water quantity over a sufficiently short time.

To flush toilet bowls, pressure flushing devices with pressure water storage means have been developed providing a certain volume of water over a certain time. Known in the prior art is a pressure flushing device described in U.S. Pat. No. 6,470,505 B1 in which flushing water is pushed out of a pressure reservoir by compressed air supported by a flexible membrane through a connection pipe and a valve to the toilet bowl. This system provides 2 litres of water in 3 seconds, which makes it clear that the initial water wave is discharged rather gradually and thus it is not forceful enough to reliably flush the toilet bowl.

Also known in the prior art is a pressure flushing device described in the published patent FR 2 552 135 in which flushing water is also pushed out of a pressure reservoir by compressed air supported by a flexible membrane through a connection pipe and a valve to the toilet bowl. This system comprises a pressure reservoir with the capacity of up to 10 litres, relatively thin flexible connecting pipe and a valve of insufficient water flow rate.

A substantial disadvantage of pressure flushing devices described in the published U.S. and French patents is that the initial discharge of water downstream from the valve is not forceful enough, i.e. the leading edge of the water discharge is not steep enough to guarantee reliability of a single flush. From the design point of view, this flushing device is difficult to install because it is not compact and it comprises many components that need to be sequentially connected to one another at the installation site.

The above disadvantages opened a space for addressing this issue by suitable technical means based on specified requirements for design simplicity, minimum water consumption and flushing and the design reliability. The outcome of this effort is a toilet bowl pressure flushing system with shock wave flushing according to the present invention as described herein.

SUMMARY OF THE INVENTION

The above disadvantages are eliminated by the toilet bowl pressure flushing system with shock wave flushing according to the present invention. The invention makes use of the energy of air compressed in a gas hydraulic accumulator ensuring a forceful discharge of water from a flow tank to the toilet bowl with an initial water shock wave after swift opening of an automatic hydraulic valve, i.e. a flushing valve with a water shock wave transfer. For the purpose of the present invention the term toilet bowl means any standing, hanging or other toilet bowl.

The essence of the invention lies in the fact that the toilet bowl pressure flushing system with shock wave flushing is a compact and possibly also universal unit made of two basic components originally permanently joined together during manufacturing. Preferably the compact unit is a rigid unit. One of its essential components comprises a combination of a gas hydraulic accumulator and a constantly flooded flow tank which has not been used in the prior art, which also results in creating a water shock wave with an extremely steep leading edge. The volume of approximately 1-3 litres of water contained in the flow tank affects how forceful and steep the water shock wave is, especially during the first second of flushing. Decaying of the shock wave with a moderate flow of the remaining water is formed only by water flowing from the decaying discharge of the gas hydraulic accumulator under minimum air pressure and water flowing from the inlet from the pressure water supply, which provides for thorough flushing of the toilet bowl. The gas hydraulic accumulator is a structural element with a volume of water and a volume of compressed air. The gas hydraulic accumulator may be made of materials such as polypropylene or a polymer-based or similar composite material. However, the gas hydraulic accumulator may also be made as a metal pressure vessel or a ceramic vessel reinforced by plastic and/or metal or carbon fibres. The gas hydraulic accumulator may have a capacity of 1.5 to 5 litres or even more if required. There is also a great variety in using a single or multiple gas hydraulic accumulators that can be integrated into the ceramic body of the toilet bowl or they can be located anywhere outside the toilet bowl. Gas hydraulic accumulators can also be placed into ceramic containers or containers made of any other suitable material and positioned next to, behind, or on top of the rear part of the toilet bowl.

The first component of the toilet bowl pressure flushing system with shock wave flushing is a pressure module designed as a rigid body containing at least a single gas hydraulic accumulator and one downstream flow tank, the interior volumes of which are connected by at least one connection opening.

The inlet from the pressure water supply can be oriented in the flow tank perpendicularly to the flow tank outlet, or the inlet from the pressure water supply. can simply be fed into the flow tank. It is also feasible to simply feed the inlet from the pressure water supply into the gas hydraulic accumulator. Finally, it is possible to feed the inlet from the pressure water supply to the inlet of the automatic hydraulic valve module.

One possible embodiment of the rigid body of the pressure module contains an inner vertical partition having at least one connection opening, which partition divides the volume of the pressure module's rigid body to at least one gas hydraulic accumulator and one flow tank.

Another embodiment of the rigid body of the pressure module contains two gas hydraulic accumulators located on top of one another and one laterally positioned flow tank interconnected with each of the gas hydraulic accumulators by a connection opening.

In one type of embodiments the overflow (outlet) pipe passes through the gas hydraulic accumulator. In another type of embodiments the overflow pipe passes outside the gas hydraulic accumulator.

The second component of the toilet bowl pressure flushing system with shock wave flushing is an automatic hydraulic valve module comprising a core and an inlet and outlet hollow element. The automatic hydraulic valve inlet element is connected to the flow tank outlet. The automatic hydraulic valve outlet element is feed into the overflow pipe. The actual automatic hydraulic valve module is further designed such that tangentially to the joint between its inlet and outlet element, the axes of which are bent into a quadrant or a right angle, is a core with a tubular valve. One end of the tubular valve fits against a saddle and the other end slides inside the inlet element, where one part of a piston extends through the tubular valve to a first spring. The other part of the piston extends through the outlet element out of the automatic hydraulic valve module. The other end of the tubular valve sliding in the inlet element is provided with a cup. The other part of the piston is controlled by a push button, a pedal or a lever manual mechanical or electromechanical control system, possibly with breaking. It may have a built-in electronic closing timer. The advantage of a push button or a pedal control is that it is self-closing. These design features of the automatic hydraulic valve significantly improve the flow rate characteristics.

If country regulations require a protection to be used to prevent drinking water contamination by backflow in the event of a failure of the negative pressure produced in the hydraulic water inlet, the requirement is complied with by incorporating a flow breaker with permanent aeration by atmospheric air between the outlet element of the automatic hydraulic valve and the overflow pipe, which protective flow breaker comprises a nozzle, an outer sleeve with an aeration opening, wherein bottom part of the nozzle is mounted in a minimum safe distance of 0.15 m or 0.400 m above the toilet bowl flood line, as defined by relevant standards of the country in question. To improve water flow trajectory the nozzle outlet face is bevelled to 50° to 70°, which also substantially contributes to the required flow transmission and robustness of the water shock wave.

The present invention also allows creating a structure in which an ejector is incorporated between the flow tank of the pressure module, comprising a gas hydraulic accumulator interconnected with the flow tank, and between the automatic hydraulic valve and the inlet from the pressure water supply. In one embodiment the ejector may be mounted on the outside of the flow tank. Connected to the ejector propulsion nozzle is the inlet from the pressure water supply. Furthermore, the suction inlet of the ejector is connected to the flow tank outlet, and the discharge outlet of the ejector feeds into the inlet of the automatic hydraulic valve module.

If the ejector is fitted inside the flow tank, then the inlet from the pressure water supply is connected to the ejector propulsion nozzle. The suction inlet of the ejector is housed inside the flow tank and the discharge outlet of the ejector is fed through the flow tank outlet to the inlet of the automatic hydraulic valve module.

The present invention does not exclude use other hydraulic components, where at least one of the components such as inlet shut-off valve, pressure reducing valve, check valve, reducer or backflow protection unit is integrated into the pressure water inlet.

The compact rigid unit of the toilet bowl pressure flushing system with shock wave flushing is made in the process of its manufacture by gluing or by bolting flanges of the inlet element of the automatic hydraulic valve module together with the outlet of the pressure module flow tank. The outlet element of the automatic hydraulic valve module is only inserted or fixed by any other suitable means to the overflow pipe.

Installation of such a compact rigid unit of the toilet bowl pressure flushing system with shock wave flushing comprises two simple steps. The first step is to take the compact rigid unit of the pressure flushing system and fit the end of the overflow pipe to the flushing opening in the ceramic toilet bowl. The second step is just to connect the inlet to a standard pressure water supply system in the building, with a pressure of about 0.15 to 0.35 MPa, or possibly other pressure.

Benefits of the toilet bowl pressure flushing system with shock wave flushing according to the present invention are apparent from their effects exhibited externally. A significant advantage is that the toilet bowl pressure flushing system with water shock wave flushing produces a forceful discharge of pressurized water to the toilet bowl in the form of a water shock wave with a steep leading edge and the flow rate of 1.5 to 4.0 litres in the first second of flushing with the pressure in the water supply system of 0.25 MPa. This is achieved by the dynamic effects of the gas hydraulic accumulator, which serves as an activator of the forced discharge of water accumulated in the flow tank. The gas hydraulic accumulator gives this water a strong and rapid impulse in order to produce a flushing shock wave with a steep leading edge. It can be assumed that the shock wave flow rate can be partially maintained at the peak state with moderate decrease in flow rate by having the inlet from the water supply positioned in the flow tank perpendicularly to the flow tank outlet towards the automatic hydraulic valve module or by having the inlet from the water supply fed into the inlet part of the automatic hydraulic valve module. This increases the robustness of the water shock wave. It can be assumed that the benefits of possibly incorporating an ejector is a moderate maintaining of the shock wave and an increased gradual flow of the decaying shock wave, thereby achieving a greater robustness of the shock wave not only due to the steep leading edge but also by partially maintaining the maximum peak of the shock wave.

The toilet bowl pressure flushing system with shock wave flushing is a compact rigid unit comprised of two basic components. The flow tank is the structural element which makes it possible to create a compact rigid unit integrating together the actual flow tank, gas hydraulic accumulator, automatic hydraulic valve, flow breaker with permanent aeration by atmospheric air and the overflow pipe. Due to simplicity of its design the universal flushing unit is suitable for mounting into various types of toilet bowls of different manufacturers. This guarantees reliability and safety of the system. It also minimizes the onsite installation time.

Principles of the implementing standards EN 14453 and EN 12541 concerning the protection against back flow and vacuum testing in conjunction with EN 1717 concerning the drinking water protection against internal contamination of water supply are complied with so that in case of an accident (occurrence of negative pressure in the hydraulic water inlet and reverse outburst of soiled water above the toilet bowl flood level) the soiled water (Class 5 water) cannot be sucked into the hydraulic outlet of the pressure flushing system and into the actual water supply.

The subject of the present invention also meets environmental criteria for being awarded an EU Ecolabel for flushing toilets no. C (2013) 7317 requiring that the flushing effect and cleaning of a toilet bowl is achieved by no more than 4 litres of water.

BRIEF DESCRIPTION OF DRAWINGS

Accompanying drawings show a toilet bowl pressure flushing system with shock wave flushing according to the present invention, in which.

DESCRIPTION OF THE PREFERRED EMBODIMENTS

It is understood that the individual embodiments of the present invention are shown by way of illustration only and not as limitations. Those skilled in the art will recognize, or be able to ascertain using no more than routine experimentation, many equivalents to the specific embodiments of the present invention. Such equivalents are intended to be encompassed by the following claims. Those skilled in the art would have no problem optimally designing such device, which is why these features were not dealt with in detail.

Example 1

Figure 1:
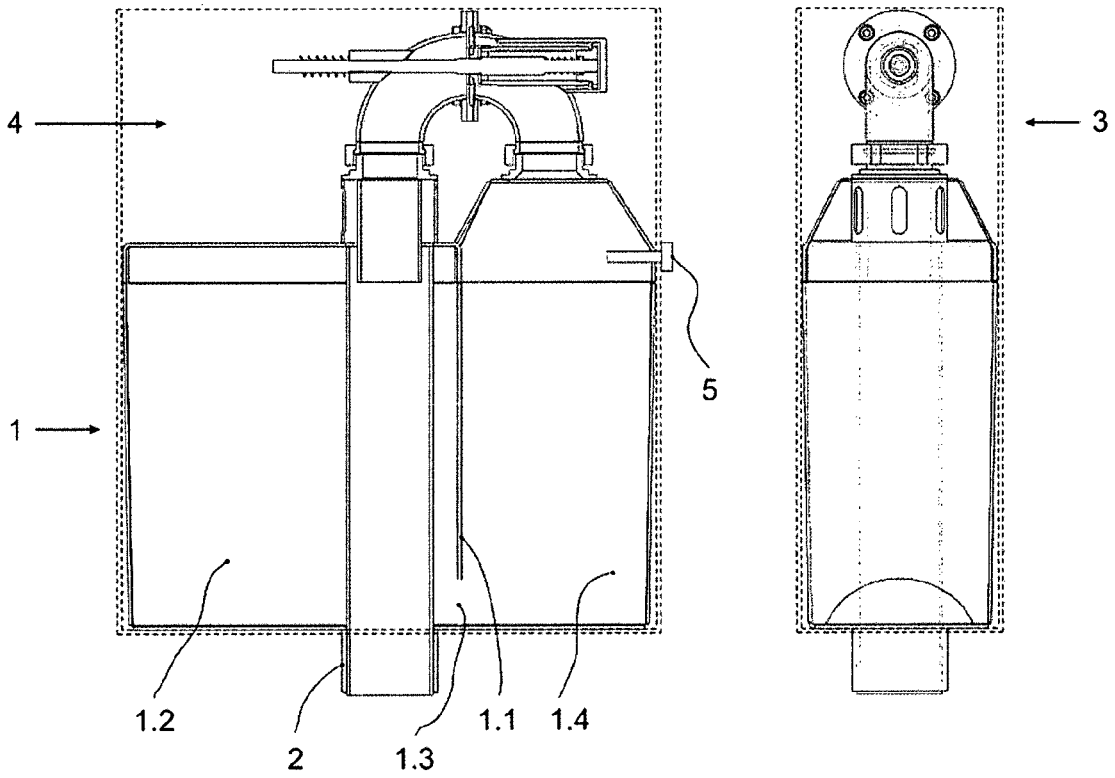
FIG. 1 shows the front and left side view of a compact rigid unit with a single gas hydraulic accumulator.
Figure 2:
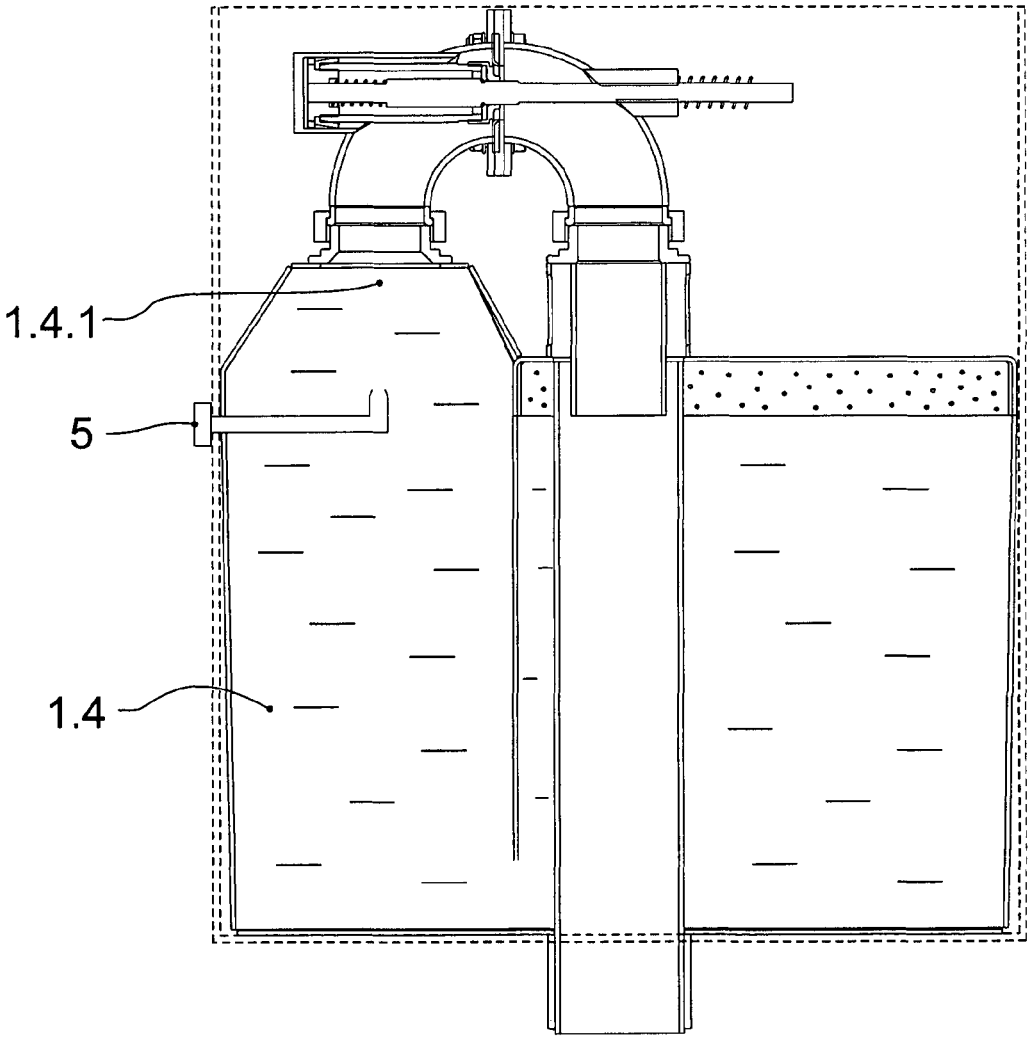
FIG. 2 shows the sectioned right side view of a compact rigid unit with a single gas hydraulic accumulator.
Figure 5:
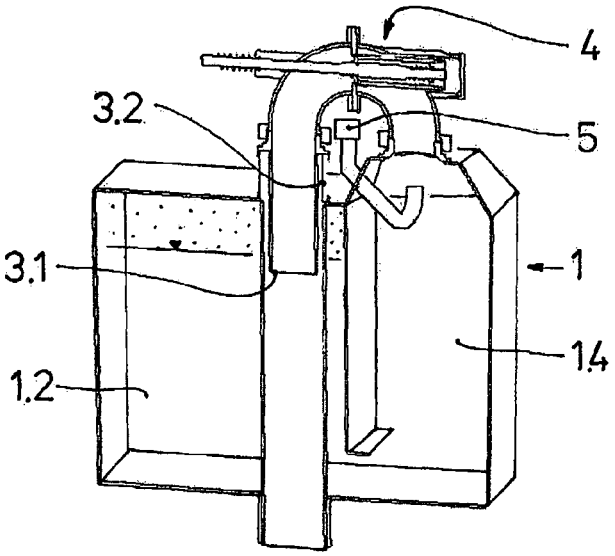
FIG. 5 shows the inlet from the pressure water supply fed from the top and directed perpendicular to the cross-sectional of the surface of the outlet of the flow tank.
Figure 6:
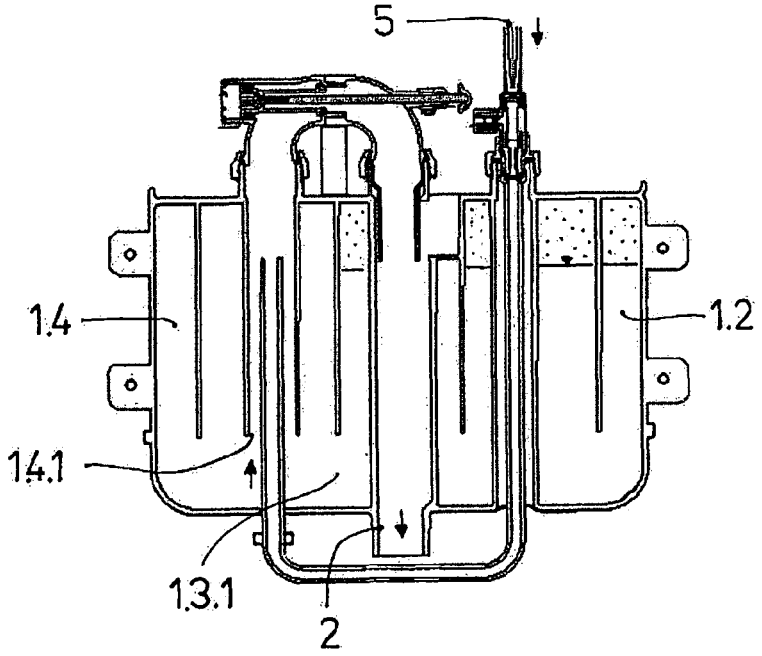
FIG. 6 shows the inlet from the pressure water supply channeled separately through the gas hydraulic accumulator and fed to the extended outlet element of the flow tank.
Figure 7:
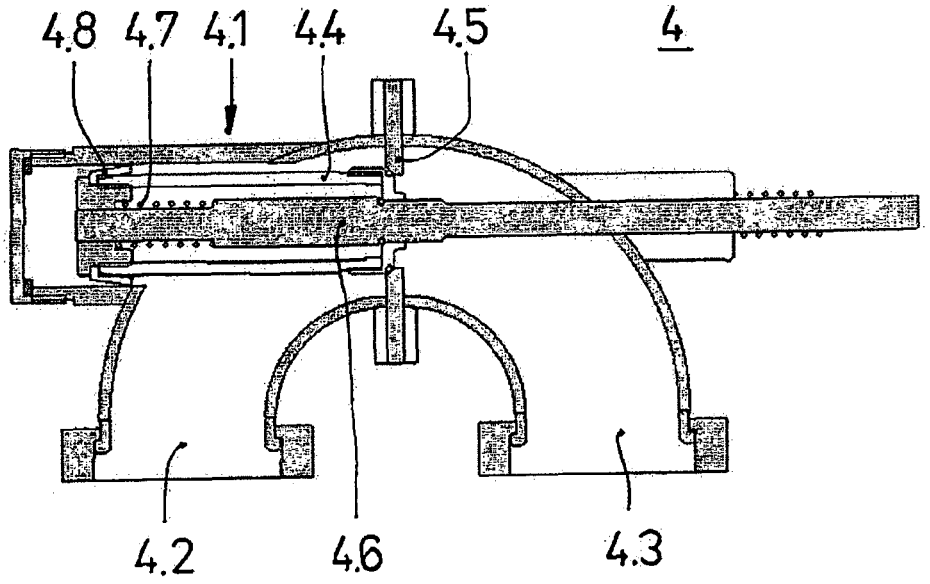
FIG. 7 shows a sectioned side view of an automatic hydraulic valve module in an arrangement with a bolted flange connection.
Figure 8:
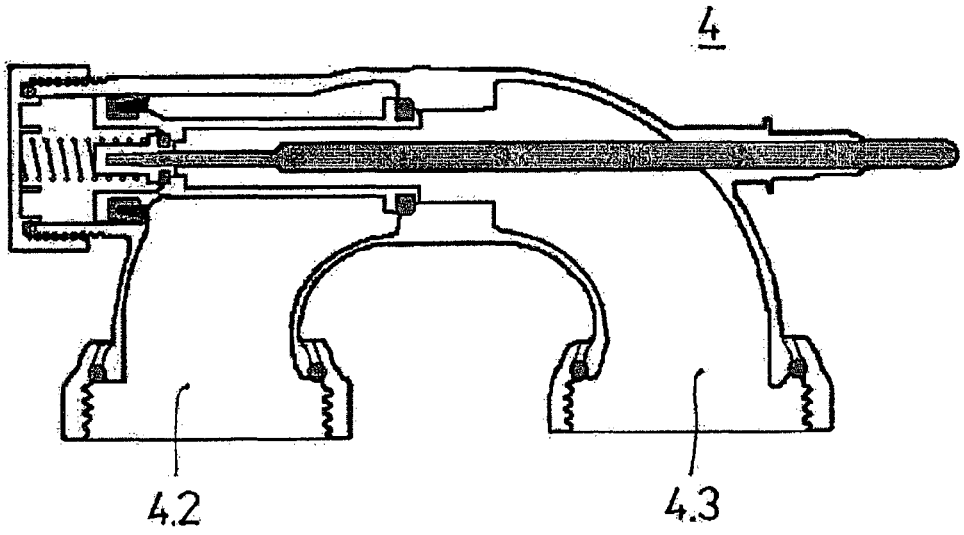
FIG. 8 shows a sectioned side view of an automatic hydraulic valve module in an arrangement with a threaded joint.
Figure 9:
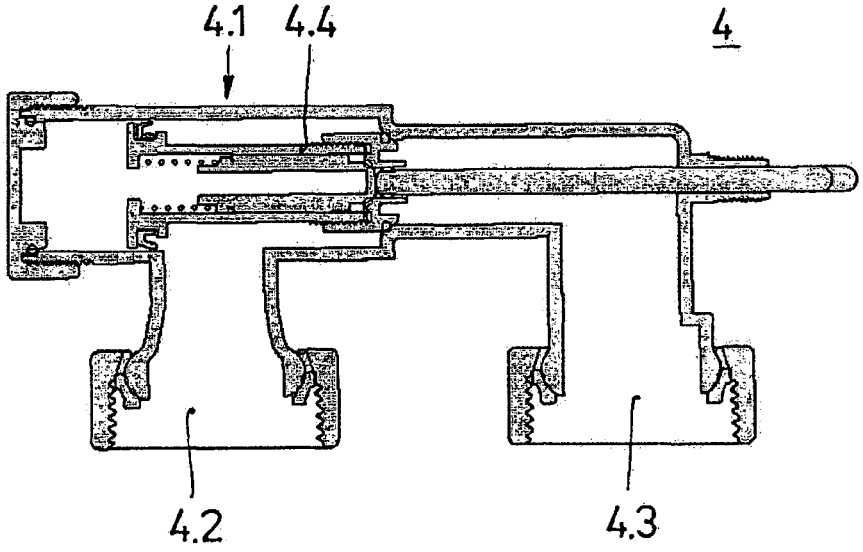
FIG. 9 shows a sectioned side view of an automatic hydraulic valve module in an arrangement as a compact casting.

This example of a particular embodiment of the invention describes a toilet bowl pressure flushing system with water shock wave flushing in its first embodiment as shown in FIGS. 1 and 2. It is designed as a compact rigid universal unit formed by original permanent joining of two basic components together. The first component is a pressure module 1 built as a rigid body with an inner vertical partition 1.1 having one connection opening 1.3, which partition divides the volume of the rigid body of the pressure module 1 to at least one gas hydraulic accumulator 1.2 and one flow tank 1.4. An overflow pipe 2 is channeled through the gas hydraulic accumulator 1.2. An inlet 5 from the pressure water supply is directed into the flow tank 1.4 and fitted to a side of the pressure module 1. Alternatively, the inlet 5 from the pressure water supply in the flow tank 1.4 is directed perpendicular to the outlet 1.4.1 of the flow tank 1.4. In another alternative, the inlet 5 from the pressure water supply is fitted from the top of the pressure module 1 as shown in FIG. 5. In another alternative, the inlet 5 from the pressure water supply is channeled separately through the gas hydraulic accumulator 1.2 and is fed into an extended outlet element 1.4.1 of the flow tank 1.4 as shown in FIG. 6. In another not shown alternative, the inlet 5 from the pressure water supply is channeled to the gas hydraulic accumulator 1.2. In another not shown alternative, the inlet 5 from the pressure water supply is channeled to the inlet part of the module 4 of the automatic hydraulic valve. The second component is the automatic hydraulic valve module 4 shown in FIG. 7 comprising a core 4.1 and inlet and outlet hollow elements 4.2 and 4.3 joined together by a bolted flange joint. The inlet element 4.2 of the automatic hydraulic valve is connected to the outlet 1.4.1 of the flow tank 1.4. The outlet element 4.3 of the automatic hydraulic valve feeds into the overflow pipe 2. The actual automatic hydraulic valve module 4 is further designed such that tangentially to the joint of the inlet element 4.2 and the outlet element 4.3, the axes of which are bent into a quadrant, is the core 4.1 with a tubular valve 4.4. One end of the tubular valve 4.4 fits against a saddle 4.5 and the other end slides inside the inlet element 4.2. At the same time one part of the piston 4.6 passes through the tubular valve 4.4 to the first spring 4.7. The other part of the piston 4.6 extends through the outlet element 4.3 out of the automatic hydraulic valve module 4. The other end of the tubular valve 4.4 sliding in the inlet element 4.2 is fitted with a cup 4.8. The other part of the piston 4.6 is controlled by a manual push control mechanism, possibly with breaking. Alternatively, the inlet and outlet hollow elements 4.2 and 4.3 of the automatic hydraulic valve are joined together by a threaded joint as shown in FIG. 8. In another alternative, the inlet and outlet hollow elements 4.2 and 4.3 of the automatic hydraulic valve are a compact casting as shown in FIG. 9, where the axes of the inlet and outlet elements 4.2 and 4.3 are bent into a right angle and the core 4.1 with tubular valve 4.4 is located in their joint. Alternatively, the automatic hydraulic valve module can be built into a wall. Incorporated between the outlet element 4.3 of the automatic hydraulic valve and the overflow pipe 2 is a flow breaker 3 with permanent aeration by atmospheric air, which flow breaker comprises a nozzle 3.1, an outer sleeve 3.2 with an aeration opening, as shown in FIGS. 1 and 5. The lower part of the nozzle 3.1 is fitted at the minimum safety height of 0.15 m or alternatively 0.40 m above the flood line.

Example 2

Figure 3:
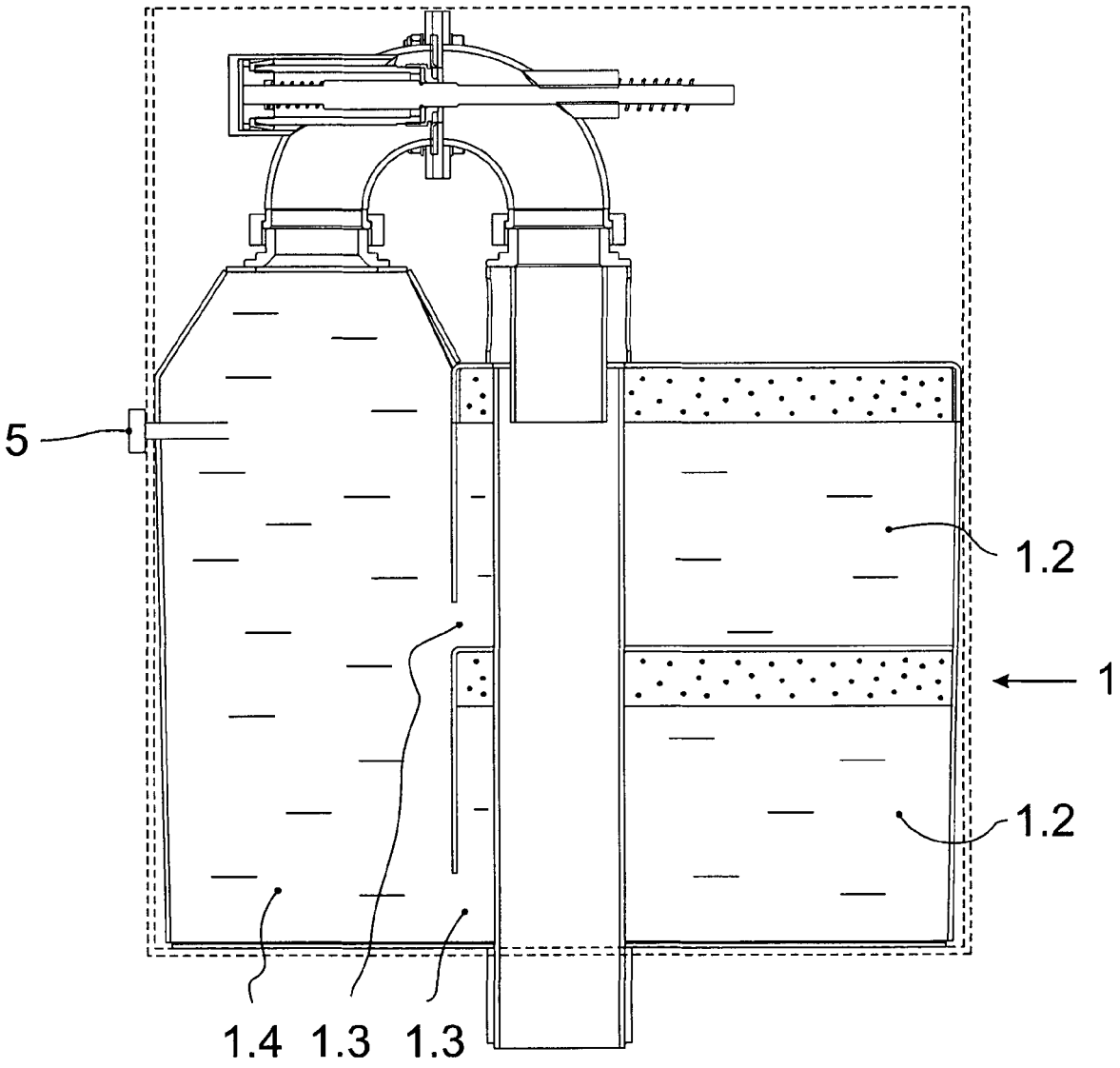
FIG. 3 shows the sectioned right side view of a compact rigid unit with two gas hydraulic accumulators.

This example of a particular embodiment of the invention describes a toilet bowl pressure flushing system with water shock wave flushing in its second embodiment as shown in FIG. 3. It has been sufficiently described in Example 1. The difference resides in the fact that the rigid body of the pressure module 1 contains two gas hydraulic accumulators 1.2 located on top of one another and one laterally positioned flow tank 1.4 interconnected with each gas hydraulic accumulator 1.2 by a connection opening 1.3.

Example 3

Figure 4:
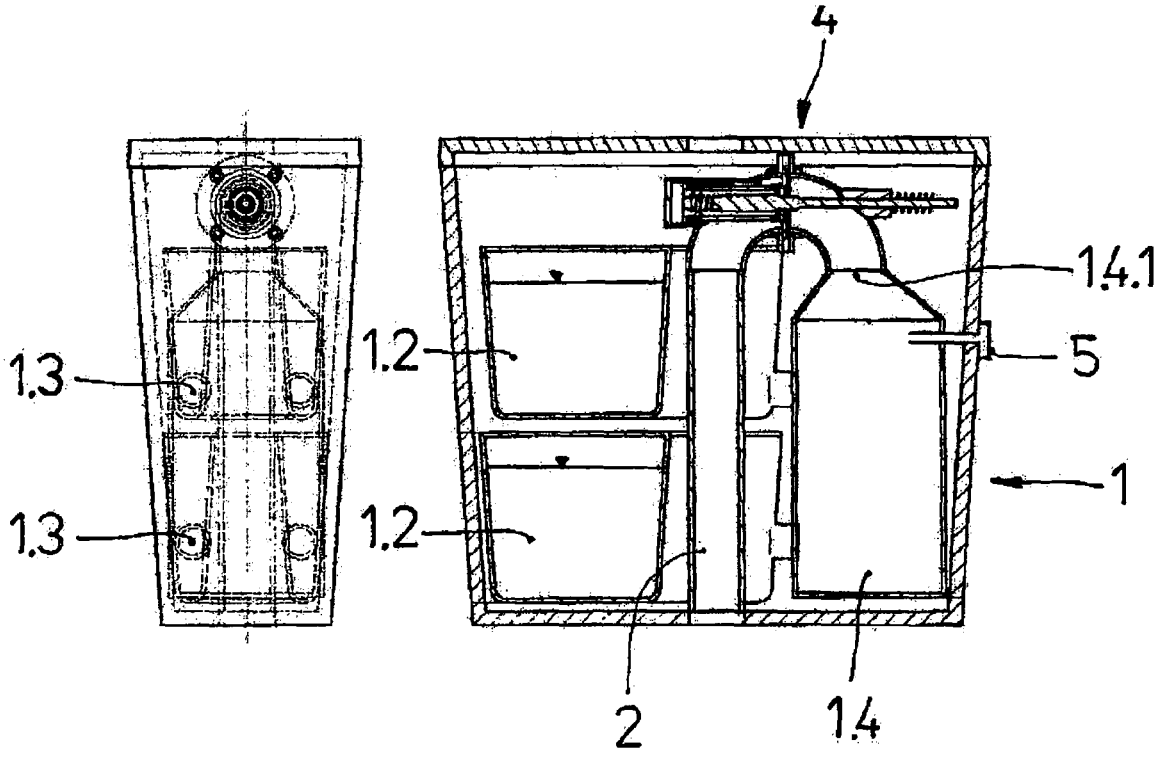
FIG. 4 shows the sectioned side and front view of a compact rigid unit with two gas hydraulic accumulators.

This example of a particular embodiment of the invention describes a toilet bowl pressure flushing system with water shock wave flushing in its third embodiment as shown in FIG. 4. It is designed as a compact rigid unit formed by original permanent joining of two basic components together. The first component is the pressure module 1 built as a rigid body comprising two gas hydraulic accumulators 1.2 located on top of one another and one laterally positioned flow tank 1.4. They are interconnected by two connection openings 1.3 located above one another. The overflow pipe 2 is channeled outside the gas hydraulic accumulator 1.2. The inlet 5 from the pressure water supply in the flow tank 1.4 is directed to the flow tank 1.4. The other component is the automatic hydraulic valve module 4 which has been sufficiently described in Example 1. The difference being that it is directly connected to the overflow pipe without any flow breaker 3 with permanent aeration by atmospheric air.

Example 4

Figure 11:
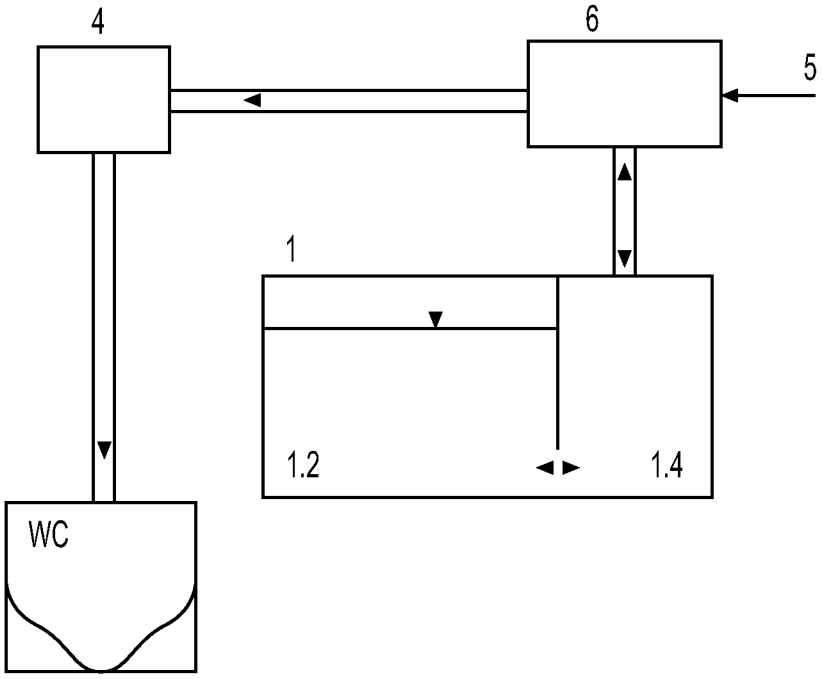
FIG. 11 shows an ejector with individual components of the flushing system.
Figure 12:
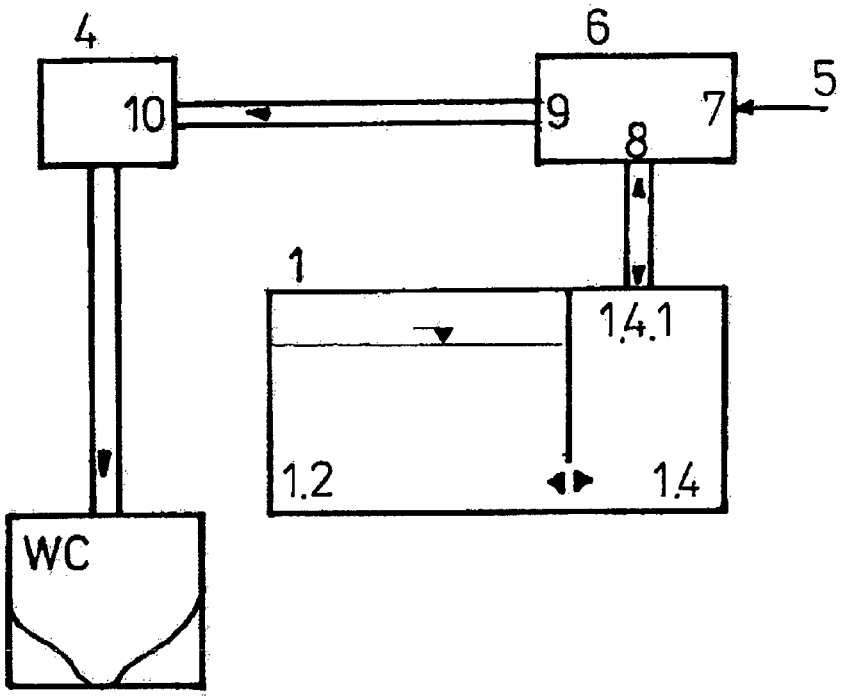
FIG. 12 shows the arrangement of a toilet bowl pressure flushing system with an incorporated ejector fitted to the outside of the flow tank.

This example of a particular embodiment of the invention describes the design of the outlet of a toilet bowl pressure flushing system with shock wave flushing as shown in FIGS. 11 and 12. The toilet bowl pressure flushing system with shock wave flushing is a compact unit comprising a pressure module 1 containing originally joined gas hydraulic accumulator 1.2 and a permanently flooded flow tank 1.4. The compact unit is complemented with an automatic hydraulic valve module 4, possibly with an incorporated flow breaker with permanent aeration by atmospheric air. The outlet of the pressure flushing system is designed in such a way that an ejector 6 is mounted to the outside of the flow tank 1.4. Connected to the propulsion nozzle 7 of the ejector 6 is the inlet 5 from the pressure water supply. Furthermore, the suction inlet 8 of the ejector 6 is connected to the outlet 1.4.1 of the flow tank 1.4.1, and the discharge outlet 9 of the ejector 6 feeds into the inlet 10 of the automatic hydraulic valve 4.

Example 5

Figure 13:
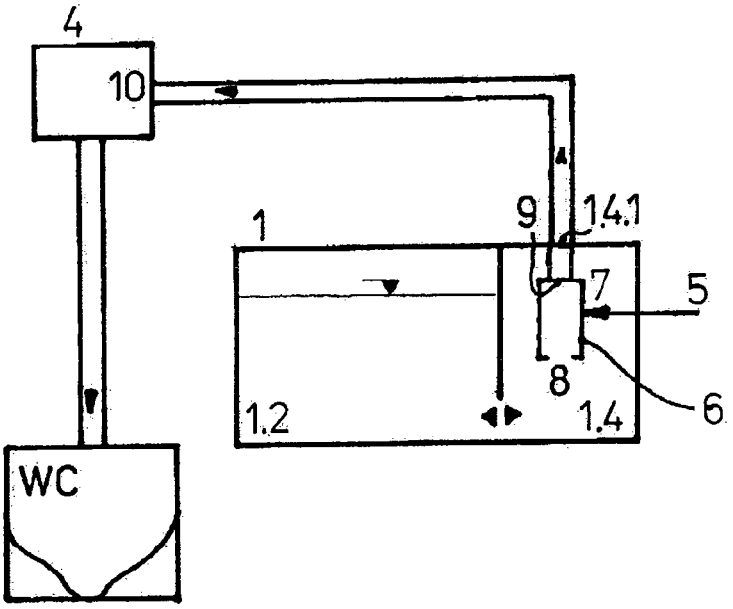
FIG. 13 shows the arrangement of a toilet bowl pressure flushing system with an incorporated ejector fitted inside of the flow tank.
Figure 14:
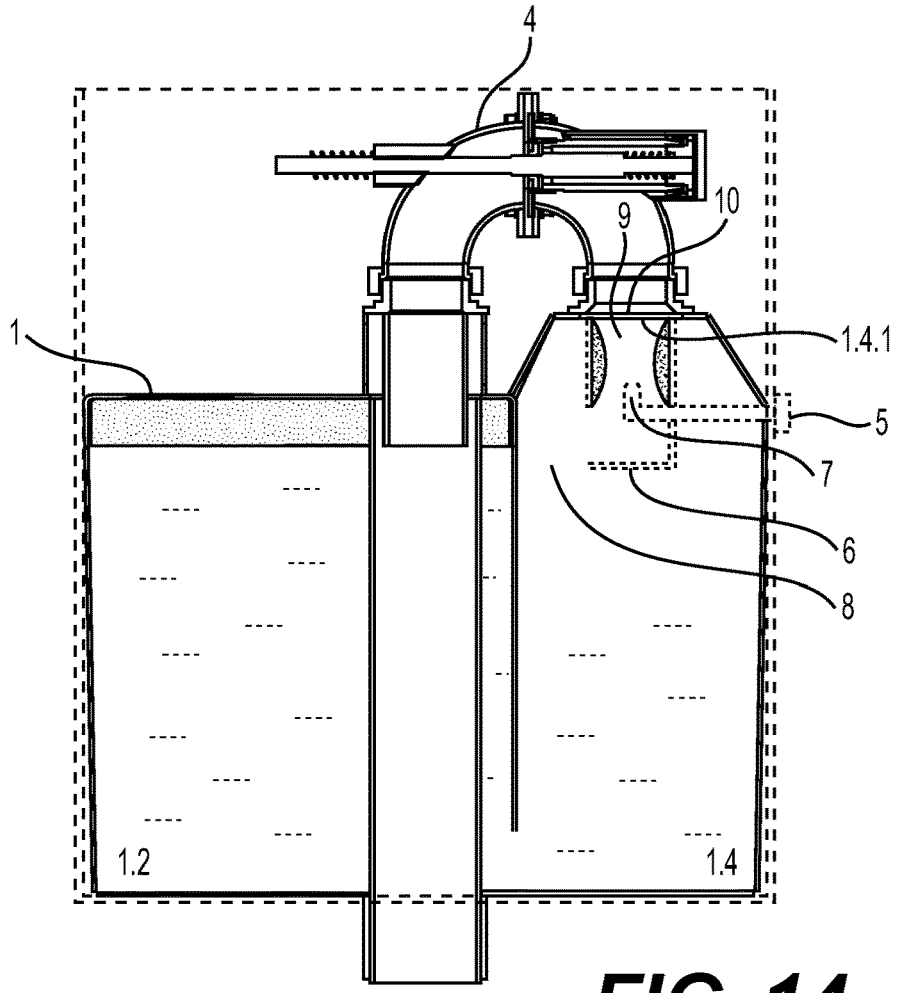
FIG. 14 shows the specific arrangement of a toilet bowl pressure flushing system with an incorporated ejector fitted inside of the flow tank.

This example of a particular embodiment of the invention describes the design of the outlet of a toilet bowl pressure flushing system with shock wave flushing as shown in FIGS. 11, 13 and 14. Toilet bowl pressure flushing system with shock wave flushing has been sufficiently described in Example 4. The outlet of the pressure flushing system is designed in such a way that an ejector 6 is mounted inside the flow tank 1.4. Connected to the propulsion nozzle 7 of the ejector 6 is the inlet 5 from the pressure water supply. Furthermore, the suction inlet 8 of the ejector 6 is housed inside the flow tank 1.4 and the discharge outlet 9 of the ejector 6 is fed through the outlet 1.4.1 of the flow tank 1.4 to the inlet 10 of the automatic hydraulic valve 4.

Figure 10:
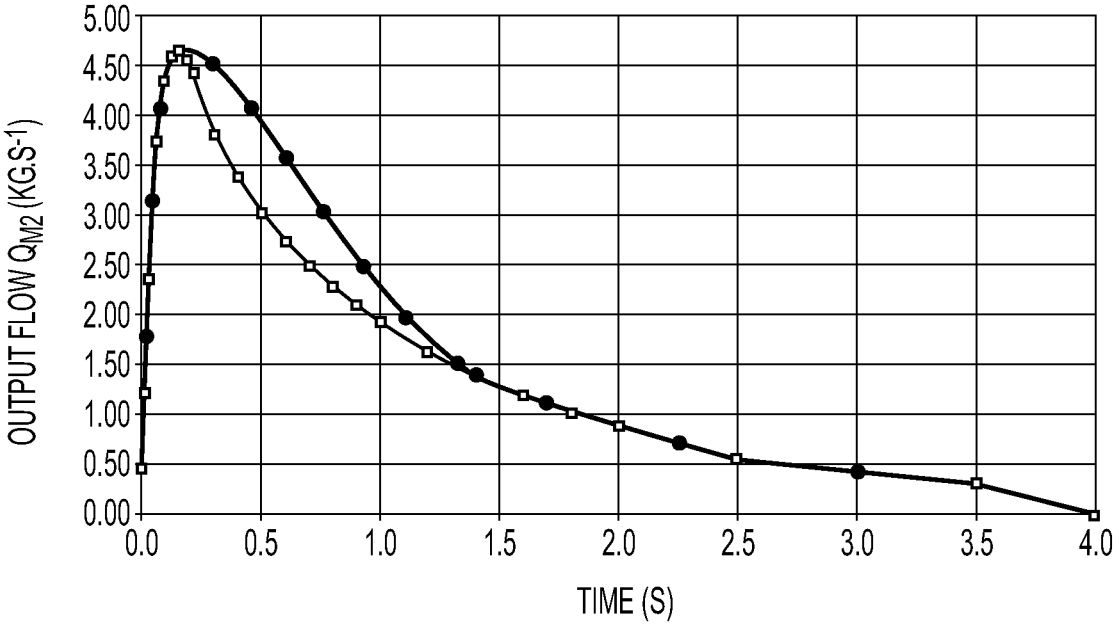
FIG. 10 shows a graphical representation of the flushing water flow rate over time with a strong shock wave.

Functionality and the achieved effect of the toilet bowl pressure flushing system with water shock wave flushing according to the present invention is presented in FIG. 10 showing a graph of flushing water flow rate over time with a significant shock wave peak. The curve with plotted squares shows clearly that due to combining the gas hydraulic accumulator 1.2 with the flow tank 1.4 the flow rate in the first second is approximately 3 litres, which represents a water shock wave with a steep leading edge of the wave rising in 0.2 seconds. Also clear is a gradual flow of 1 litre of water over four seconds representing the trailing edge of the shock wave. Decaying of the shock wave is formed only by water flowing from the inlet 5 from the pressure water supply, which then fills in the gas hydraulic accumulator 1.2. A higher efficiency is assumed if the inlet 5 from the pressure water supply in the flow tank 1.4 is directed perpendicular to the outlet 1.4.1 of the flow tank 1.4, which assumption is shown by the curve with plotted dots, where the steep 0.2 second leading edge of the wave is followed by an extended period of max water flow rate with slower decay making the shock wave more robust.

Figure 15:
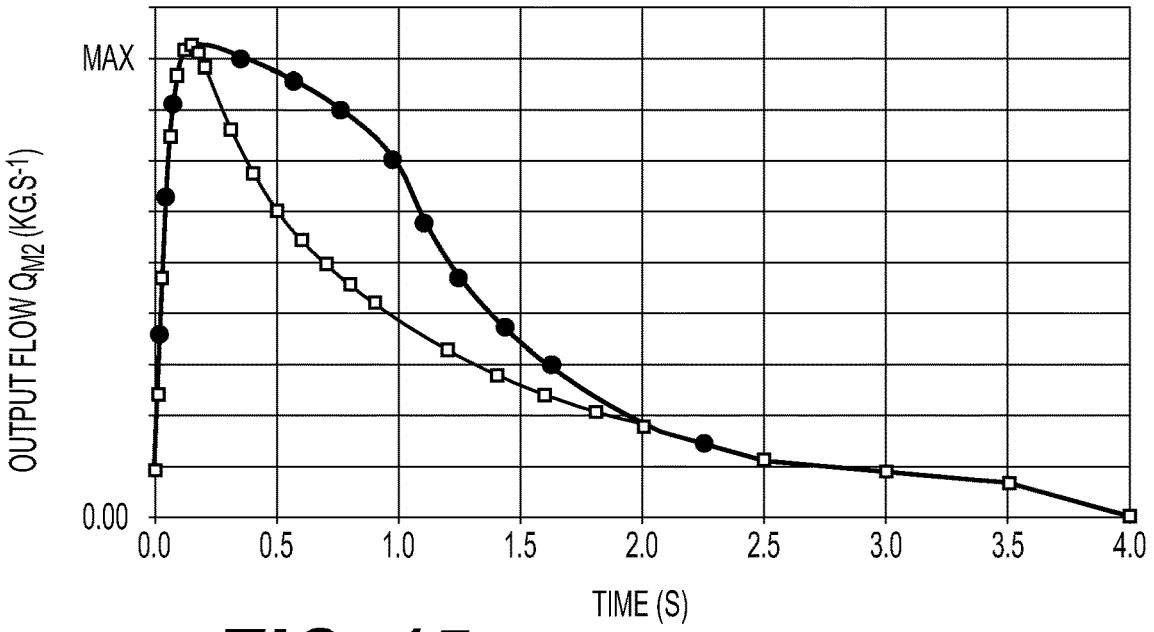
FIG. 15 shows a graphical representation of the flushing water flow rate over time with a strong shock wave and with additional flow rate in the shock wave decay phase improving the shack wave duration.

Similarly, a higher efficiency is assumed according to FIG. 15, if an ejector 6 is incorporated into the flushing system causing a shock wave to be moderately extended at about 0.5 of the maximum water flow rate, making the shock wave more robust. The curve plotted with squares represents the water flow rate with no ejector. The curve plotted with dots represents the water flow rate with an incorporated ejector 6. The maximum value of water flow rate can be sized based on requirements of manufacturers and users by sizing the volume of the gas hydraulic accumulator 1.2.

Achieved efficiency of the pressure flushing system can be significantly improved if the volume of the gas hydraulic accumulator 1.2 is divided by one or more horizontal partitions 1.5 to separate volumes stacked on top of one another and each connected with the flow tank 1.4 by a separate connection opening 1.3, because by this arrangement the water surface area in individual volumes of the gas hydraulic accumulator 1.2 gets increased multiple times and so does the water displacement force making the shock wave more robust.

INDUSTRIAL APPLICABILITY

The toilet bowl pressure flushing system with water shock wave flushing according the present invention finds its use in applications of sanitary equipment and appliances.

The invention claimed is:

1. A toilet bowl pressure flushing system with shock wave flushing comprising a gas hydraulic accumulator including:

a rigid body of a pressure module containing the gas hydraulic accumulator and a downstream flow tank interconnected by at least one connection opening;

an overflow pipe; and an automatic hydraulic valve module comprising a core, an inlet and outlet elements of the automatic hydraulic valve module, where the inlet element of the automatic hydraulic valve module is connected to an outlet of the downstream flow tank and where the outlet element of the automatic hydraulic valve module feeds into the overflow pipe;

wherein the downstream flow tank comprises an inlet from a pressure water supply;

wherein the rigid body of the pressure module comprises an inner vertical partition with the at least one connection opening located at a bottom of the rigid body, which partition divides the pressure module into the gas hydraulic accumulator and the downstream flow tank; and wherein an ejector of water distributed from the pressure water supply is connected to the inlet of the pressure water supply, and the ejector is connected simultaneously to the downstream flow tank of the pressure module and to a module of an automatic hydraulic closure.

2. A toilet bowl pressure flushing system with shock wave flushing according to claim 1 wherein the ejector is mounted outside of the downstream flow tank such that the inlet from the pressure water supply is connected to a propulsion nozzle of the ejector, wherein a suction inlet of the ejector is connected to the outlet of the downstream flow tank and a discharge outlet of the ejector feeds into the inlet element of the automatic hydraulic valve module.

3. A toilet bowl pressure flushing system with shock wave flushing according to claim 1 wherein the ejector is mounted inside the downstream flow tank such that the inlet from the pressure water supply is connected to a propulsion nozzle of the ejector, wherein a suction inlet of the ejector is located inside of the downstream flow tank and a discharge outlet of the ejector feeds through the outlet of the downstream flow tank into the inlet element of the automatic hydraulic valve module.

4. A toilet bowl pressure flushing system with shock wave flushing according to claim 1 wherein the overflow pipe is channeled through the gas hydraulic accumulator.

5. A toilet bowl pressure flushing system with shock wave flushing according to claim 1 wherein incorporated between the outlet element of the automatic hydraulic valve module and the overflow pipe is a flow breaker with permanent aeration by atmospheric air, which flow breaker comprises a nozzle, an outer sleeve with an aeration opening, wherein a bottom part of the nozzle is mounted in a safe distance above a flood line of the downstream flow tank.

* * * * *